US012650007B2

(12) United States Patent
Senanayake et al.

(10) Patent No.: US 12,650,007 B2
(45) Date of Patent: Jun. 9, 2026

(54) RETAINER SYSTEMS

(71) Applicant: 2MT MINING PRODUCTS PTY LTD., Queensland (AU)

(72) Inventors: Mahinda Palitha Senanayake, Queensland (AU); David Garnet John Conroy, Queensland (AU); Michael John Swinscoe, Queensland (AU); Benjamin James Baker, Western Australia (AU)

(73) Assignee: 2MT MINING PRODUCTS PTY LTD., Queensland (AU)

( * ) Notice: Subject to any disclaimer, the term of this patent is extended or adjusted under 35 U.S.C. 154(b) by 723 days.

(21) Appl. No.: 17/617,661

(22) PCT Filed: Jul. 13, 2020

(86) PCT No.: PCT/AU2020/050721
§ 371 (c)(1),
(2) Date: Dec. 9, 2021

(87) PCT Pub. No.: WO2021/011993
PCT Pub. Date: Jan. 28, 2021

(65) Prior Publication Data

US 2022/0243430 A1 Aug. 4, 2022

(30) Foreign Application Priority Data

Jul. 22, 2019 (AU) ..... 2019902587

(51) Int. Cl.
*E02F 9/28* (2006.01)

(52) U.S. Cl.
CPC ..... *E02F 9/2883* (2013.01); *E02F 9/2816* (2013.01); *E02F 9/2833* (2013.01); *E02F 9/2841* (2013.01)

(58) Field of Classification Search
CPC ..... E02F 9/28; E02F 9/2808; E02F 9/2816; E02F 9/2825; E02F 9/2833; E02F 9/2883; E02F 3/8152
See application file for complete search history.

(56) References Cited

U.S. PATENT DOCUMENTS 5,088,214 A 2/1992 Jones
5,272,824 A * 12/1993 Cornelius ..... E02F 9/2825 37/456

(Continued)

FOREIGN PATENT DOCUMENTS

AU 2010330673 B2 5/2013
CN 205839839 U 12/2016

OTHER PUBLICATIONS

International Search Report and Written Opinion for the PCT Application No. PCT/AU2020/050721, mailed on Oct. 6, 2020, 23 pages.

*Primary Examiner* — Christopher J Sebesta
*Assistant Examiner* — Audrey L Lusk
(74) *Attorney, Agent, or Firm* — Amster, Rothstein & Ebenstein LLP

(57) ABSTRACT

A wear part and retainer system in combination, for earth-moving and mining equipment, the wear part having a first passage extending therethrough in one direction and a second passage extending in a direction lateral to and intersecting the first passage. The first and second passages each have an outer end and an inner end. A latching member is mounted in the first passage for movement between a non-latching position and a latching position in which it locks the wear part to a mother part. The latching member has a recess therein and a biasing element mounted in the recess. A locking pin is mounted in the second passage for selective movement along the passage between a retracted position in which the latching member is free to move into and out of the recess and an extended position in which it locks the latch in the latching position.

18 Claims, 12 Drawing Sheets

(56) References Cited

U.S. PATENT DOCUMENTS

| | | | | |
|---|---|---|---|---|
| 7,219,454 | B2 * | 5/2007 | Maher | E02F 9/2833 37/456 |
| 10,563,381 | B2 * | 2/2020 | Voelz | E02F 9/2825 |
| 10,612,214 | B2 * | 4/2020 | Zenier | E02F 9/2833 |
| 11,427,990 | B2 * | 8/2022 | Kunz | E02F 9/2833 |
| 2003/0101627 | A1 * | 6/2003 | Robinson | E02F 9/2825 37/456 |
| 2010/0115804 | A1 * | 5/2010 | Lopez Almendros | E02F 9/2833 37/456 |
| 2010/0162594 | A1 * | 7/2010 | Bierwith | F16B 33/02 411/366.3 |
| 2010/0170119 | A1 | 7/2010 | Lopez Almendros et al. | |
| 2013/0174453 | A1 * | 7/2013 | Cheyne | E02F 9/2825 37/456 |
| 2014/0173949 | A1 * | 6/2014 | Karlsson | E02F 9/2833 37/455 |
| 2014/0352182 | A1 * | 12/2014 | LaHood | E02F 9/2841 37/455 |
| 2015/0211214 | A1 | 7/2015 | Dallard et al. | |
| 2017/0022690 | A1 * | 1/2017 | Tasovski | H01Q 25/00 |
| 2017/0073939 | A1 | 3/2017 | Bjerke et al. | |
| 2017/0226718 | A1 * | 8/2017 | Snyder | E02F 9/2825 |
| 2017/0328037 | A1 * | 11/2017 | Serrurier | E02F 9/2841 |
| 2017/0370076 | A1 * | 12/2017 | Campomanes | E02F 9/2833 |
| 2018/0044895 | A1 * | 2/2018 | Rol Corredor | E02F 9/2841 |
| 2020/0157782 | A1 * | 5/2020 | Bjerke | E02F 9/2833 |

* cited by examiner

RETAINER SYSTEMS

CROSS-REFERENCE TO RELATED APPLICATIONS

This application claims priority to PCT application no. PCT/AU2020/050721, filed Jul. 13, 2020, which claims priority to Australian application no. 2019902587, filed Jul. 22, 2019, the contents of which are incorporated by reference herein in their entireties.

FIELD OF INVENTION

This invention relates to retainer systems for wear parts and rigging components for earthmoving and mining equipment. The invention has particular application to wear parts for excavator buckets and dragline buckets and the invention will be described with particular reference to such application. However, the invention also has application to wear parts for other types of equipment, for example, shovel buckets, bucket loaders, bulldozer blades, drotts, bobcats, and backhoes. The invention also has application to retainer systems for load bearing pins such as trunnion pins, anchor pins and the like, especially pins which are subject to significant wear and have to be replaced relatively often but it may also have application to other types of wear parts or pins which have to be reliably secured or locked in a working position.

BACKGROUND OF RELATED ART

In this specification, the term "wear parts" generally includes lip shrouds, nose mounts, teeth and adaptors, for mounting the teeth to the nose mounts, lips and lip shrouds, lip end protectors, wing shrouds, drag hitch protectors, anchor brackets and pins, drag pins and socket brackets, trunnion brackets and pins and similar wear parts even though the invention will be described with particular reference to one or two specific types of wear parts.

Typically, excavator buckets, dragline buckets and the like have a base or floor with a cutting edge (or lip) to which ground engaging tools are fitted to engage the ground or spoil which is to be excavated or loaded as the case may be and to protect the lip from wear. The ground engaging tools which are generally subject to the greatest wear are the teeth and a number of parts are associated with the teeth. The first component, often called the nose or nose mount, is usually fixed in a permanent or semi-permanent manner to the base of the bucket or the lip by welding and protrudes forward from the lip. The second component is releasably mounted on or to the nose so that it can be replaced when it reaches a predetermined wear condition. In some types of equipment the second component is the cutting tip, tooth, or tooth point which engages the ground at its front edge and suffers the main wear while in other equipment, the second component is an adaptor to which a third component being the cutting tip or tooth is releasably fitted which in turn suffers the main wear while the adaptor suffers lesser wear. Thus, it will be understood that while the teeth in a three component system will have a much shorter life than the adaptors, the adaptors themselves do eventually wear out and have to be replaced. Even the nose may wear out long before the bucket floor and walls and will have to be replaced but in the case of the noses, they can be cut away from the base and be replaced by new noses which can be welded to the base but that requires substantial downtime for a fairly substantial operation. In the case of a two component system, while the releasable teeth can be replaced relatively easily, if the noses wear out, a fairly substantial operation is required to replace them as with a three component system.

Further, the portions of the lip between the spaced apart noses also dig to some extent and in any event are exposed to the abrasive effects of spoil flowing across the upper face thereof and at the same time the lower face suffers the abrasive effects of sliding across the uncut ground. While the lip itself may be a semi-permanent wear plate which is welded to the bucket floor, replacement from time to time can require a substantial time consuming operation. Consequently, in order to extend the life of a lip or lip plate, lip shrouds are often fitted between the nose mounts and welded to the lip plate or secured to the lip or the floor by a retainer system which allows them to be removed and replaced as required.

In some buckets, the lip extends sideways beyond the side walls of the bucket and the ends of the lip outside the bucket are subject to abrasion by spoil flowing past the end of the lip or by the end of the lip moving relative to the material being mined or excavated. The lip ends are typically covered by lip end protectors which are fitted thereto so as to protect the lip ends themselves from wear by the spoil flowing past in much the same manner as the lip shrouds protect the lip from spoil flowing between the teeth and the adapters.

In some buckets, especially dragline buckets, the front vertical (or inclined) edges of the side walls are covered by replaceable wear parts typically referred to as wing shrouds.

Thus, it will be appreciated that where possible, those parts of portions of a bucket which are most subject to wear are protected by components which can be more easily and cost effectively replaced as they wear rather than replacing the more permanent parts of the bucket.

SUMMARY

The present invention is aimed at providing wear parts and retainer systems for securing the wear parts to the relevant parts of the bucket which for ease of reference will be referred to in the specification as "the mother part" or "the mother component" or "the mother material" or some similar term.

While teeth, adapters, lip shrouds, lip end protectors and the like are subject to more wear than other components and consequently will likely benefit from the present invention more than other wear parts, there are other wear parts which do require replacement throughout the life of the bucket, for example, drag hitch protectors, anchor brackets and pins, drag pins and socket brackets, trunnion brackets and pins, and such components will also likely benefit from the present invention. Some such components may not be commonly referred to as wear parts in mining and earthmoving industries, but in this specification, such components are considered to be "wear parts".

One of the difficulties with retainer systems for retaining replaceable wear parts on the mother part is that the retainer systems are subject to incursion of "fines" from the spoil, that is very small particles of spoil. Where threaded fasteners such as bolts are used to secure the wear part to the mother part, the fines work their way into the threads and cause the bolts or nuts to seize which makes removal difficult. There have been many attempts to overcome the problem, for example, U.S. patent application Ser. No. 12/724,322 (published as US 2010/0170119 teaches the use of a locking pin with a radially extending lug which is arranged to engage with a washer-like member more or less in the manner of a bayonet fitting with the washer being formed of a resilient material with a seat for the lug, the resilient material being adapted to apply an axial force to the lug to hold it in the seat. One of the problems with that system is that the washer itself being formed of the resilient material, wears too quickly and becomes loose.

The present invention is aimed at providing a retainer system and wear parts for use with the retainer system which overcome or at least ameliorate one or more of the problems of the presently available systems.

The present invention in one form provides a retainer system in which one component secures the wear part to the mother part and a locking pin is used to lock that component in the securing position. The invention also provides a locking pin having a head at one end with a seat and a helical face or inclined face adapted to engage a complementary lug in a wear part so as to cause the pin to move axially upon rotation whereby the lug can come to rest in the seat, and a separate resilient washer arranged to apply an axial force to the pin so as to bias the seat against the lug.

In this specification, unless the context clearly requires a different meaning, the term forward and its derivatives are to be understood as being in the direction of movement of the lip or bucket when digging or filling the bucket with spoil. Terms such as upper, lower, side, front, rear, and the like are to be understood in the context of the bucket moving forward so that the leading edge of the lip or the teeth is the front. Similarly, the term horizontal is to be understood as approximately the orientation relative to the bottom of the bucket when resting on the ground and vertical is a direction generally upstanding from horizontal although it may be used to refer to a wall or component which is not "vertical" in a purely geometric sense. Such terms are used herein to assist in describing the invention and are not intended to limit the invention to use in any particular orientation.

With the foregoing in view the invention in one aspect resides broadly in an assembly of a wear part and a retainer system for earthmoving and mining equipment, the wear part having a first passage extending therethrough in one direction and a second passage extending in a direction lateral to and intersecting the first passage;

a latching member mounted in and extending beyond said first passage to a latching position; and a locking pin mounted in said second passage and engaging said latching member so as to hold said latching member in the latching position.

In another aspect, the invention resides broadly in a retainer system for earthmoving and mining equipment, the retainer system being adapted to secure a wear part to a mother part, the retainer system including:

a latching member adapted to be mounted in a first passage extending through the wear part to be secured to the mother part for movement between a non-latching position and a latching position; and a locking pin adapted to be mounted in a second passage extending in a direction lateral to and intersecting the first passage of the wear part so as to engage said latching member and hold it in the latching position.

In yet another aspect, the invention resides broadly in a wear part and retainer system in combination, for earthmoving and mining equipment;

the wear part having a first passage extending therethrough in one direction and a second passage extending in a direction lateral to and intersecting the first passage, the first and second passages each having an outer end and an inner end;

a latching member mounted in said first passage for movement between a non-latching position and a latching position in which it locks the wear part to a mother part, said latching member having a recess therein and biasing means mounted in said recess;

a locking pin mounted in said second passage for selective movement along said passage between a retracted position in which the latching member is free to move into and out of said recess and an extended position in which it locks said latch in the latching position.

Preferably, the wear part has at least one lug extending into the second passage for engagement by the locking pin. In a preferred form said at least one lug has an inner face facing towards the inner end of the second passage adapted for engagement by the locking pin. In such form of the invention, it is also preferred that said locking pin has a head or other protuberance with an outer end face adapted to engage the inner face of the at least one lug, the outer end face leading to a seat adapted to locate the lug therein.

Preferably, said locking pin also has an inner face, at least a portion of said inner face being spaced from said outer end face and adapted to engage said biasing means, said locking pin and said biasing means being so made and arranged that rotation of said locking pin in said passage causes axial movement of said locking pin relative to said wear part upon movement of said outer end face against the inner face of said lug such that relative movement between said locking pin and said lug results in said lug being in said seat and is retained in said seat against the force of said biasing means.

In another aspect, the invention resides broadly in a wear part and retainer system in combination, for earthmoving and mining equipment, the wear part having a passage therethrough, the passage having an outer end and an inner end, and at least one lug having an inner face extending into the passage, the retainer system including a locking pin for locking the wear part to a mother part and biasing means for biasing the locking pin in a locked position, the locking pin having a head or other protuberance with an outer end face adapted to engage the inner face of the at least one lug, the outer end face leading to a seat adapted to locate the lug therein, the locking pin also having an inner face, at least a portion of said inner face being spaced from said outer end face and adapted to engage said biasing means, said locking pin and said biasing means being so made and arranged that rotation of said locking pin in said passage causes axial movement of said locking pin relative to said wear part upon movement of said outer end face against the inner face of said lug such that said lug moves relative to said locking pin into said seat and is retained in said seat against the force of said biasing means.

Preferably, the locking pin has a head or protrusion with an outer end face having a helical or inclined portion leading to a peak followed by a helical or declined portion leading to a trough followed by another helical or inclined leading portion, the trough defining a seat portion adapted to locate therein the inner face of the lug extending into the through passage of the wear part.

In another aspect, the invention resides broadly in a retainer system for earthmoving and mining equipment, the retainer system including a locking pin for locking a wear part to a mother part, the locking pin having a head with an outer end face having a helical or inclined portion leading to a peak followed by a helical or declined portion leading to a trough, the trough defining a seat portion adapted to locate therein a complementary lug on a wear part. Preferably, the trough is followed by another helical or inclined leading portion or an abrupt end face.

In another aspect, the invention resides broadly in a locking pin for a retainer system the locking pin having a head or protrusion with an outer end face with a helical or inclined portion leading to a peak followed by a helical or declined portion leading to a trough.

In another aspect, the invention resides broadly in a locking pin for a retainer system the locking pin having a shank with a head or protrusion extending from the shank, the head or protrusion having an outer end face with a helical or inclined portion leading to a peak followed by a helical or declined portion leading to a trough.

In such forms of the invention it is preferred that the trough be followed by another helical or inclined leading portion, the trough defining a seat portion adapted to locate therein a complementary lug on a wear part. However, in some cases it is preferred that the trough be followed by an abrupt face to prevent further movement of the pin relative to the lugs.

Preferably, the locking pin head includes at least two protuberances spaced angularly around the axis of the locking pin and the pin head and each of said protuberances has an outer end face having a helical or inclined portion leading to a peak followed by a helical or declined portion leading to a trough followed by another helical or inclined leading portion, the trough defining a seat portion adapted to locate therein a complementary lug on a wear part. Suitably, in such form the space between the protuberances is sufficient to allow complementary angularly spaced lugs extending into a complementary through passage of the wear part to pass therethrough for fitting the pin to the wear part and suitably, the helical or inclined portions rise in the same angular direction.

Preferably, the head of the locking pin has an inner face adapted to engage the biasing means, the inner face being spaced from the seat portion in the axial direction of the locking pin. In one preferred form where the biasing means includes a resilient compression washer, the inner face is substantially planar for the purpose of engaging the compression washer evenly over its engagement face.

In another aspect, the invention resides broadly in a locking pin for a retainer system, the locking pin including a head with an outer end face having a helical or inclined portion leading to a peak followed by a helical or declined portion leading to a trough followed by another helical or inclined leading portion, the trough defining a seat portion adapted to locate therein a complementary lug on a wear part, the locking pin having a shoulder spaced from said head, said shoulder being adapted to engage a compression washer or a washer adapted to engage with a compression washer.

In yet another aspect, the invention resides broadly in a wear part for earthmoving and mining equipment, the wear part having a mounting portion for engaging with a mount such as a nose mount or adaptor, a cheek plate, a boot, a lip or lip end or the like provided on the bucket, the wear part having a cavity in the mounting portion defined at least in part by a wall having an outer face and an inner face, a passage formed through said wall and opening at one end to the outer face of said wall and at the other end to the inner face of said wall; and a pair of angularly spaced apart lugs extending into said passage between said outer face and said inner face, each of said lugs having a lower end face adapted to be engaged by a substantially helical or inclined face of a locking pin.

Preferably, the lower end face of said lugs is curved about an axis substantially perpendicular to the axis of said passage, that is, in a radial direction. In one such preferred form, the lugs said lower end face is semi-cylindrical in a radial direction.

In yet another aspect, the invention resides broadly in an assembly of a wear part and a retainer system for earthmoving and mining equipment, the wear part having a passage therethrough, the passage having an outer end and an inner end and at least one lug having an inner face extending into the passage, the retainer system including a locking pin for locking the wear part to a mother part and biasing means mounted in said passage, the locking pin having a head with an outer end face arranged to engage the inner face of the at least one lug, the outer end face leading to a seat adapted to locate the lug therein, the locking pin also having an inner face, at least a portion of said inner face being spaced from said outer end face and arranged to engage said biasing means to bias the locking pin to a locked position with said lug in said seat, said locking pin and said biasing means being so made and arranged that rotation of said locking pin in said passage causes axial movement of said locking pin relative to said wear part upon movement of said outer end face against the inner face of said lug such that said lug moves into and is retained in said seat against the force of said biasing means.

In yet another aspect, the invention resides broadly in a wear part for protecting mother parts of earthmoving and mining equipment, including:

a weld-on base part adapted to be welded to the mother part to be protected, including:

an elongate first portion having a side face adapted to abut a face of the mother part to which the wear part is to be mounted and a second portion extending from said first portion, said second portion forming keying means for keying the wear part thereto, said second portion having a recess formed therein and adapted to receive a latching member from a retainer system as previously described to latch a wear part to said weld-on base part as previously described.

In yet another aspect, the invention resides broadly in a lip end protector wear part for earthmoving and mining equipment, including:

a weld-on base part adapted to be welded to the end face of an excavator lip, including:

an elongate first portion having a side face adapted to abut the end face of the lip to which the end protector is to be mounted and a second portion extending from said first portion, said second portion forming keying means for keying an end protector wear part thereto, said second portion having a recess formed therein and adapted to receive a latching member from a retainer system as previously described to latch a wear part to said weld-on base part as previously described.

In still yet another aspect, the invention resides broadly in a mother part for earthmoving and mining equipment, including:

keying means adjacent a face of the mother part to be protected and adapted to slidably receive thereon a wear part;

a recess formed in the mother part and adapted to receive the latching member of a retainer system as previously described so as to latch a protector wear part thereto as previously described.

In still yet another aspect, the invention resides broadly in a lip for earthmoving and mining equipment, including:

keying means adjacent one end of the lip adapted to slidably receive thereon a lip end protector wear part;

a recess formed in the end of the lip and adapted to receive the latching member of a retainer system as previously described so as to latch a lip end protector wear part thereto as previously described.

BRIEF DESCRIPTION OF THE DRAWINGS

In order that the invention may be more easily understood and put into practical effect, reference will now be made to the accompanying drawings wherein.

DETAILED DESCRIPTION OF THE EMBODIMENTS

Figure 1B:
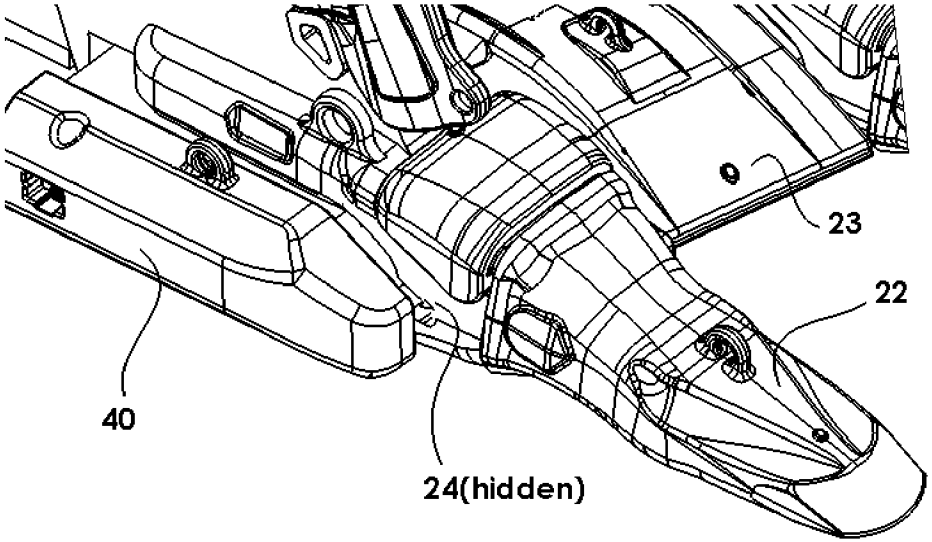
FIG. 1*b* is a pictorial representation of a portion of the excavator bucket of FIG. 1*a* from one front corner and enlarged.
Figure 1A:
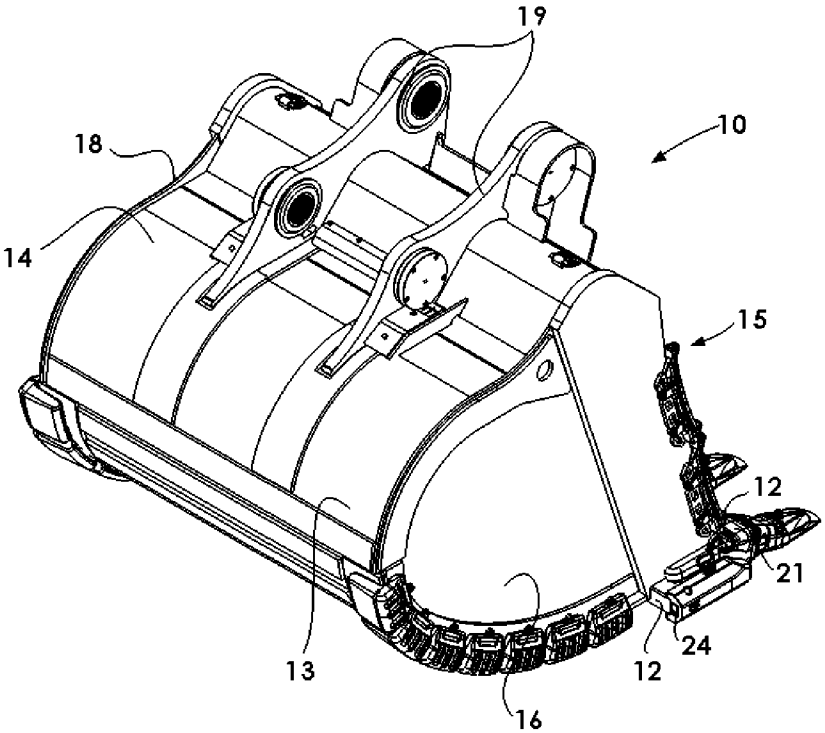
FIG. 1*a* is a pictorial representation of an excavator bucket with a lip end protector according to the present invention fitted thereto.
Figure 2:
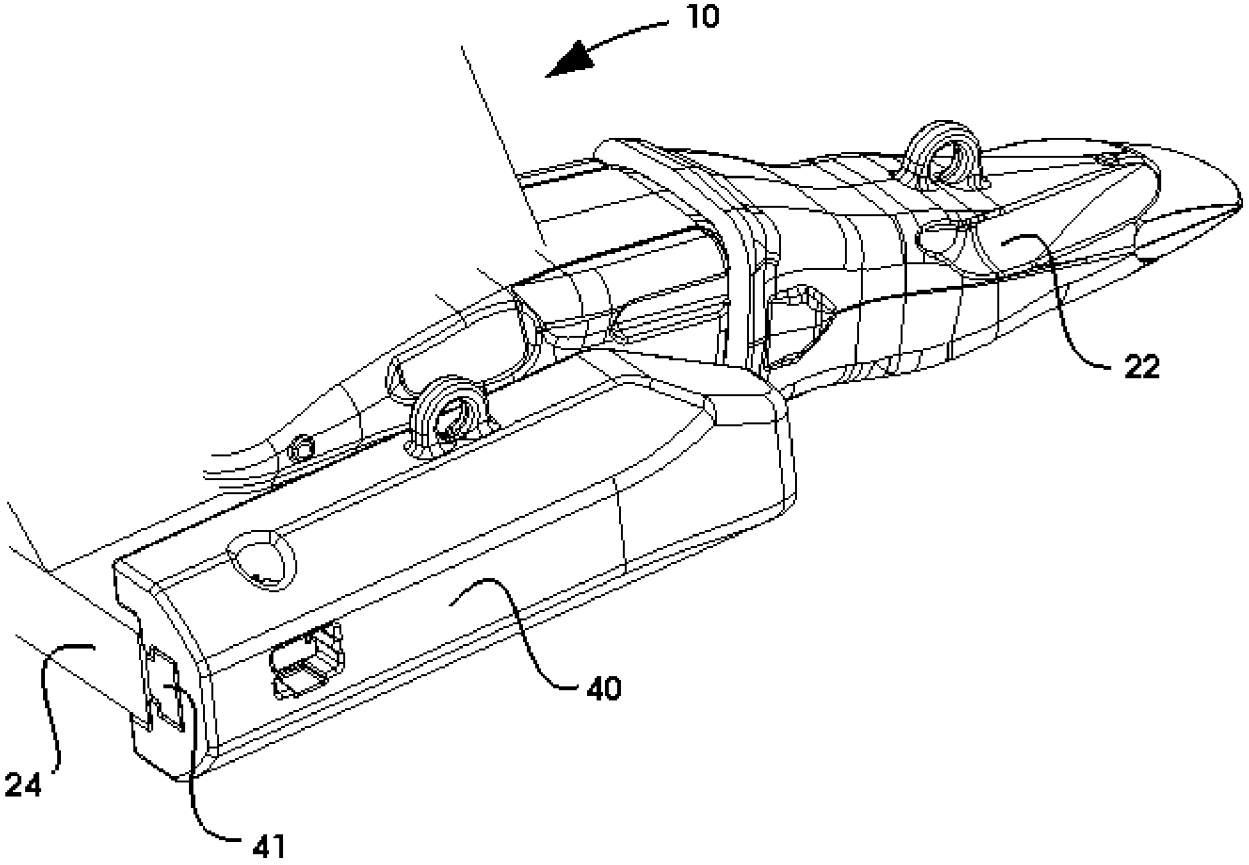
FIG. 2 is an enlarged drawing of part of FIG. 1 showing the lip end protector more clearly from one side.

The bucket 10 illustrated in FIGS. 1*a* and 1*b* has a floor 11 with a ground engaging leading edge (or lip) 12 at its front. The floor curves upwardly behind the lip to form a contiguous rear wall 13 which in turn curves upwards and forwards to form a contiguous upper wall 14, the floor, the rear wall and the upper wall forming a generally u-shaped bucket enclosed by opposed generally planar side walls 16 and 18 with an open front 15. Spaced apart lifting mounts 19 are welded to the upper wall for connection of an excavator crowd arm thereto in known manner.

A plurality of spaced apart nose mounts 21 are welded to the lip 12 across the front and extend forward therefrom and teeth 22 are fitted to the nose mounts in known manner. Lip shrouds 23 are fitted to the lip between the teeth to protect the lip.

Figure 3:
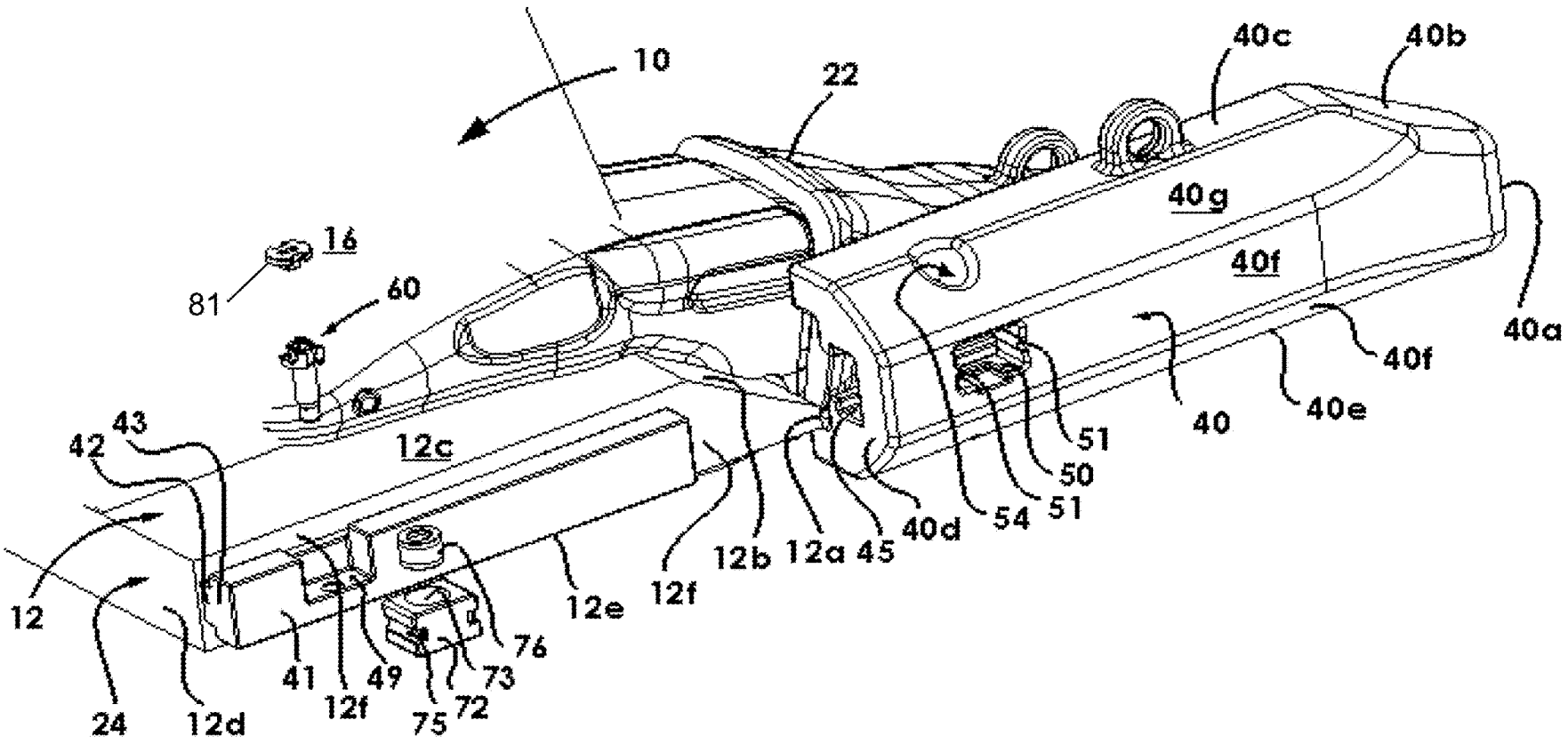
FIG. 3 is the drawing of FIG. 2 with the lip end protector shown in line for assembly.
Figure 4:
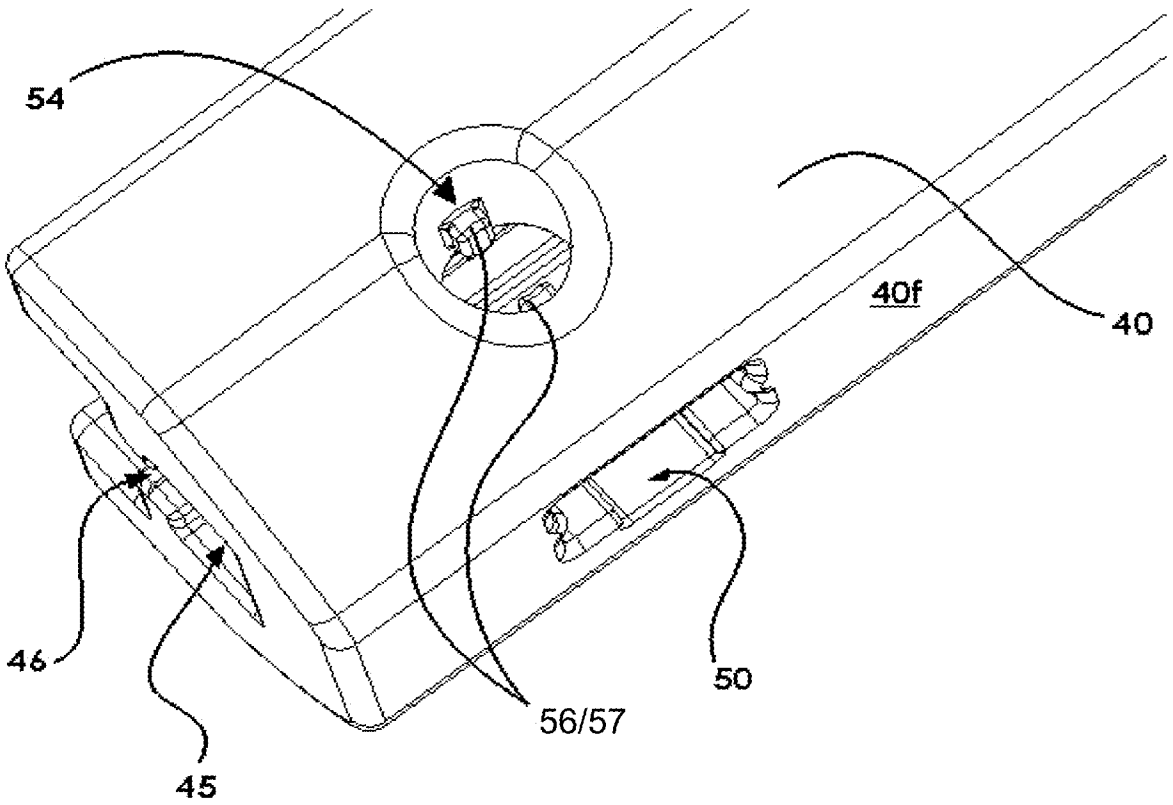
FIG. 4 is a pictorial representation of part of the lip end protector shown in FIG. 1 from a different aspect.

As can be seen in FIG. 1*a* and FIG. 3, the lip 12 extends beyond the side wall 16 and terminates at end 24. The lip extends rearward from a front leading-edge 12*a* which is contiguous with an upwardly tapered face 12*b* leading into the bucket followed by a generally horizontal upper face 12*c*, a vertical rear face 12*d* and a horizontal bottom face 12*e* which is adapted to rest on the ground. The lip terminates at end face 12*f* and a lip end protector 40 according to the present invention is mounted to the lip at its end face 12*f* as will be described in more detail later. A similar lip end protector being a mirror image is mounted on the other end of the lip in the same manner.

In order to mount the lip end protector 40 to the lip end, a weld-on base 41 is first welded to the end face 12*f* of the lip 12 to provide a keying means or rail on which the end protector 40 can be slidably mounted. The weld-on base 41 is generally T-shaped in cross-section when viewed from the front or the rear with the leg 42 of the T extending sideways to meet the end face 12*f* to which it is welded and the top 43 of the T extending vertically and effectively forming a flange spaced from face 12*f* by the length of the leg.

Advantageously, the end protector 40 has a shape which complements the shape of the lip as previously described with a leading-edge 40*a* at the front corresponding to the leading-edge 12*a* of the lip itself and spaced forward therefrom when mounted, an upwardly tapered face 40*b* leading over the lip followed by a generally horizontal upper face 40*c*, a vertical rear face 40*d* and a horizontal bottom face 40*e* which is adapted to rest on the ground. The lip end protector has a vertical side face 40*f* corresponding to end face 12*f* of the lip 12 as well as two tapered side faces 40*g* and 40*h* between side face 40*f* and upper face 40*c* and lower face 40*e*.

Advantageously, the end protector 40 has a channel 45 formed therein of generally T-shaped cross-section which complements the T-shaped cross-section of the weld on base 41 and the channel extends forward from its rear end face 40*d* towards the leading front face 40*a* but terminating approximately at the point where the tapered upper face 40*b* joins upper face 40*c*, that is, approximately where the upper flat face 40*c* of the lip starts to taper downwards.

Channel 45 open sideways along its full length to form a space 46 between opposed elongate rails 47 and 48 (see, e.g., FIG. 6), the rails 47 and 48 being adapted to engage with the opposite faces of the leg 42 of the T shaped weld on base. The channel is partly defined by opposed upper and lower faces which slidably engage the upper and lower faces of the T-shaped weld on base to effectively key the end protector 40 to the weld on base.

As can be seen in FIGS. 3-6, a recess 49 is provided in the flange part 43 of the weld on base 41 for receiving therein a latching block 72 for a purpose which will be explained more fully later. A passage or bore 49*a* is provided in the weld-on base 41 below the recess 49 and centrally thereof for receiving therein an end portion of the shank 63 of steel locking pin 60 which is constructed of high tensile steel although other steels would be suitable in some applications.

Lip end protector 40 has two passages provided therein, the first passage 50 is a horizontal passage which extends inwards from side face 40*f* and intersects channel 45 and extends to the rails 47 and 48. Passage 50 is suitably sized and shaped to slidably receive the latching block 72 therein from the outer face 40*f* of the lip end protector.

Figure 6:
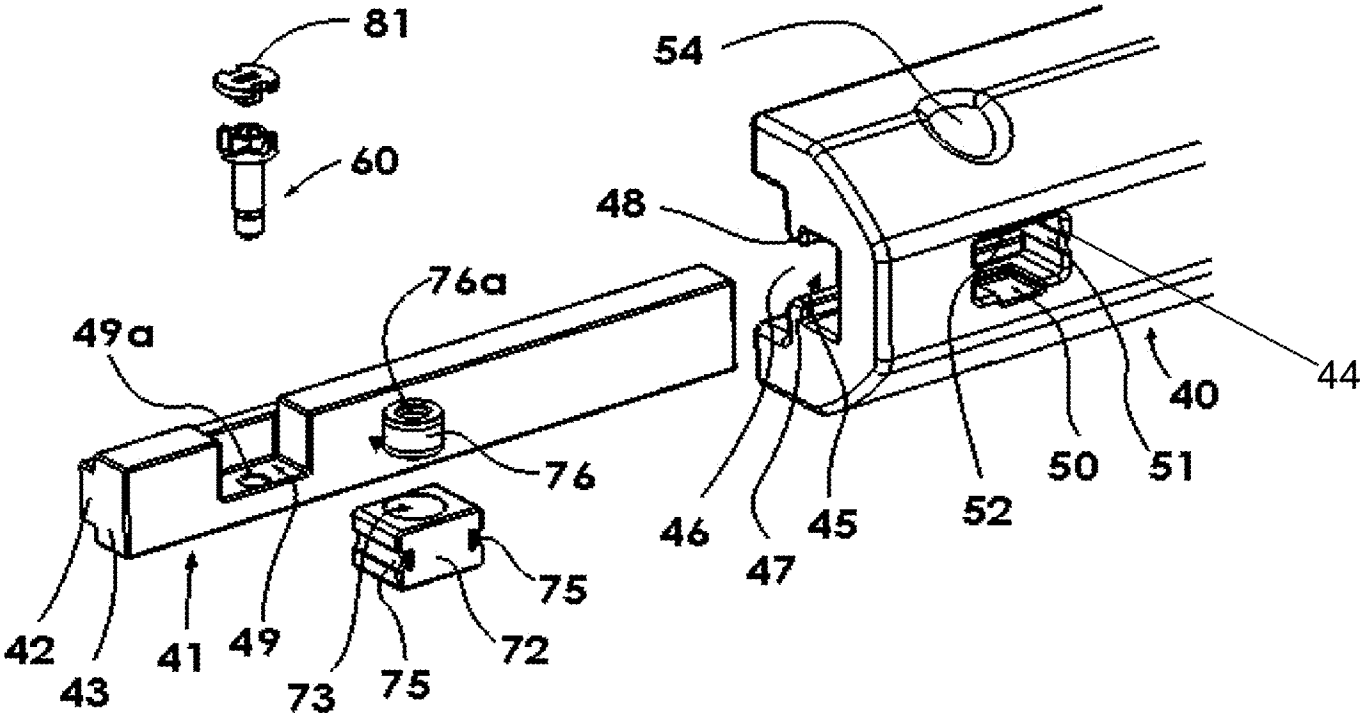
FIG. 6 is a pictorial representation of the weld on base part together with the lip end protector wear part and latching and locking components in line for assembly.
Figure 7:
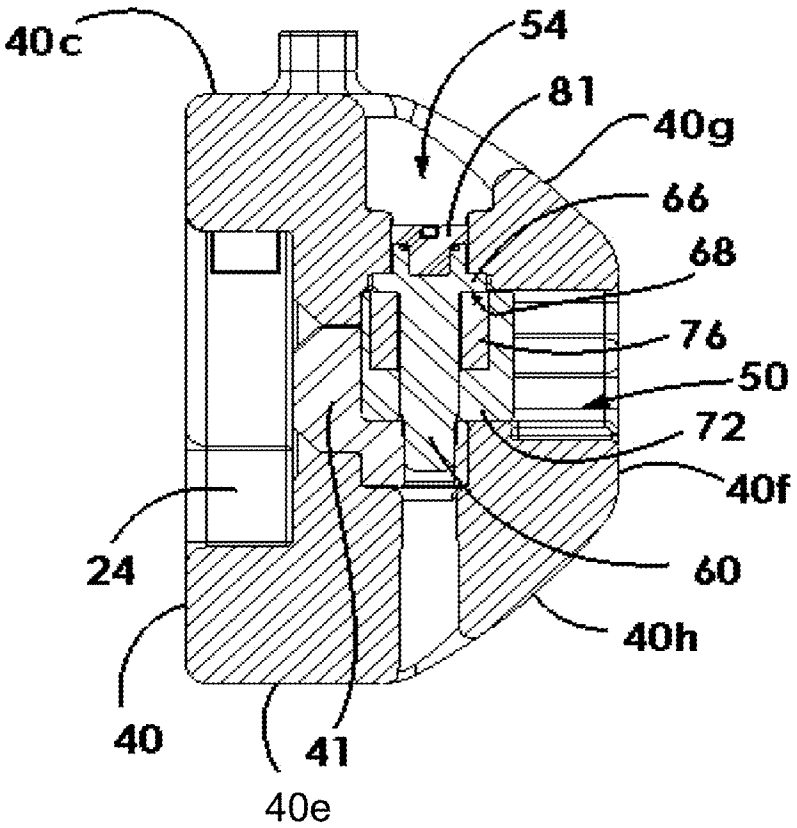
FIG. 7 is a sectional view of the lip end protector assembly fitted to the bucket lip through the longitudinal axis of the locking pin component from the rear.

Referring to FIG. 6, a cylindrical recess 73 is provided in the latching block 72, the recess being adapted to house therein a complementary cylindrical compression washer or block 76. The latching block 72 also has channels 75 provided in opposite side faces thereof, for engaging with complementary spaced apart rails 51 and 52 which extend into the horizontal passage 50 in the side wall of the lip end protector 40 so as to stabilize the latching member 72 and guide it into the desired latching position. Suitably, the compression washer 76 has a through hole 76*a* therein for receiving therethrough the shank 63 of the locking pin 60.

Figure 8:
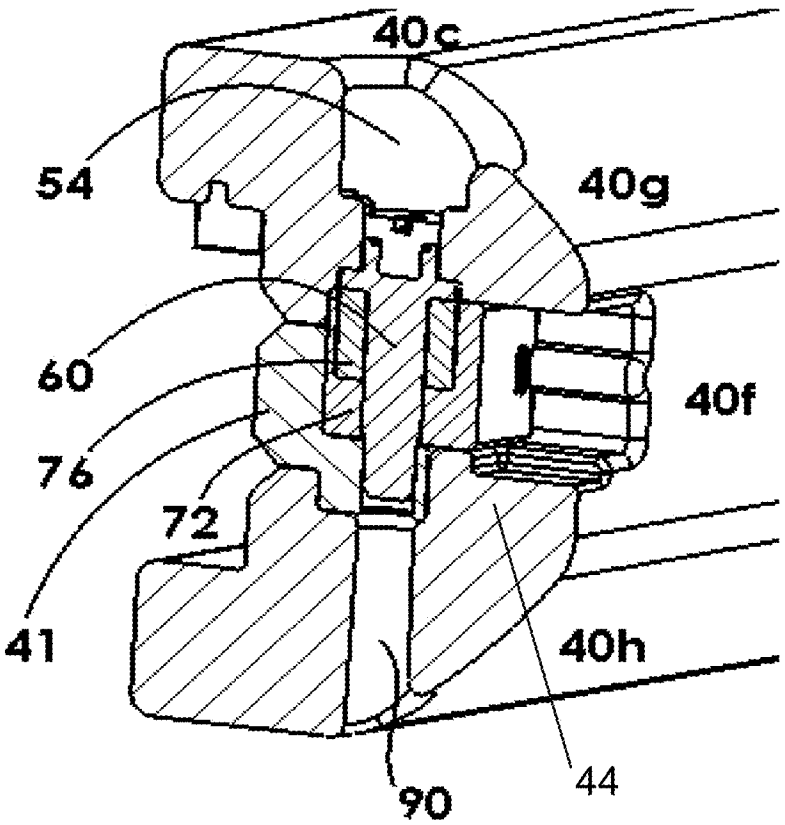
FIG. 8 is a sectional pictorial representation of the lip end protector assembly fitted to the bucket lip through the longitudinal axis of the locking pin component from the rear.
Figure 9:
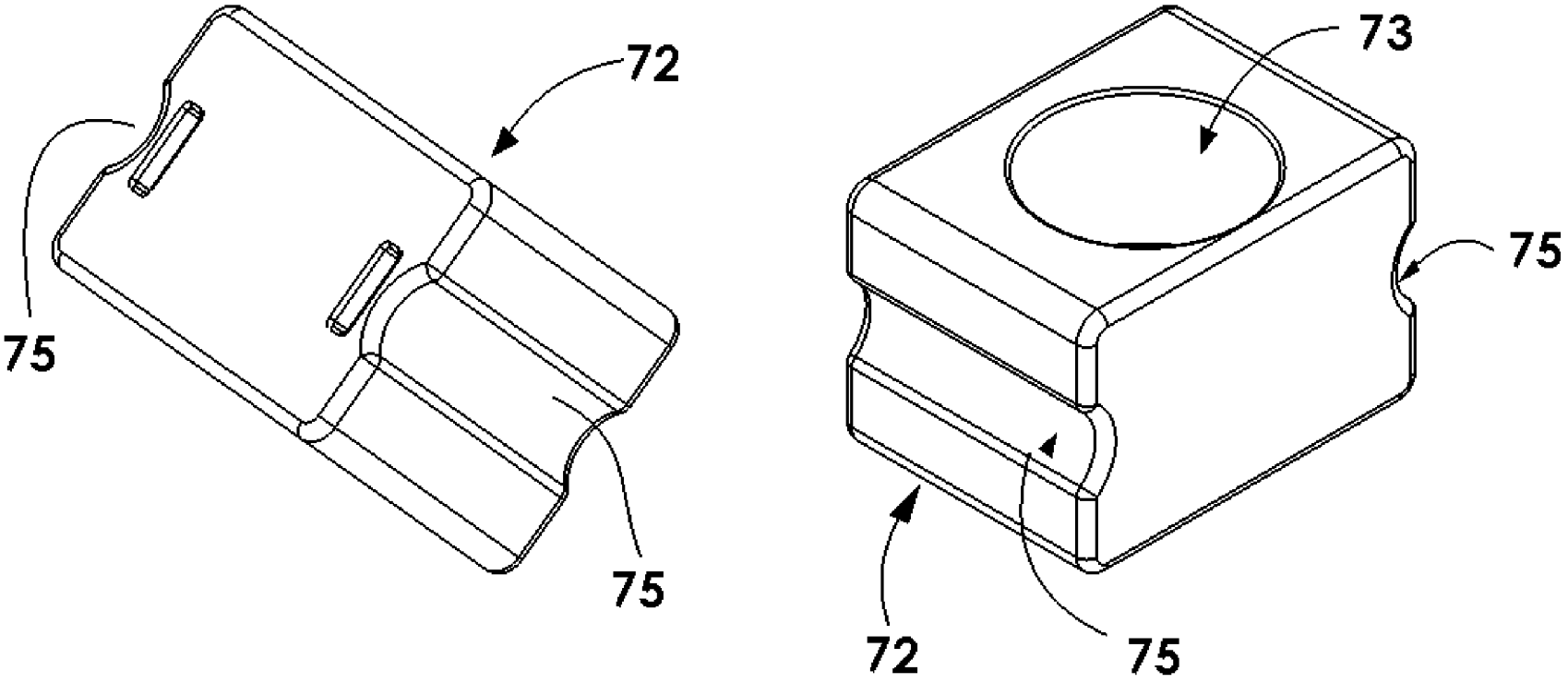
FIG. 9 shows two pictorial representations of the latching member in which the compression washer of the assembly is fitted.

The second passage provided in the lip end protector 40 is a vertical passage 54 which extends downwards from the upper face 40*c* (or partly from tapered upper face 40*g*) and intersects channel 45 and opens to bottom face 40*h*. Vertical passage 54 is suitably adapted to receive therein locking pin 60 which will be described in more detail later and secure the locking pin therein by way of two opposed lugs 56 and 57 extending into the vertical passage 54. The lower portion 90 (FIG. 8) of passage 54 allows a punch or the like to be used to drive out a seized pin from the vertical passage if the need arises and also assists with aligning the latching block 72 in the recess 49.

Figure 5B:
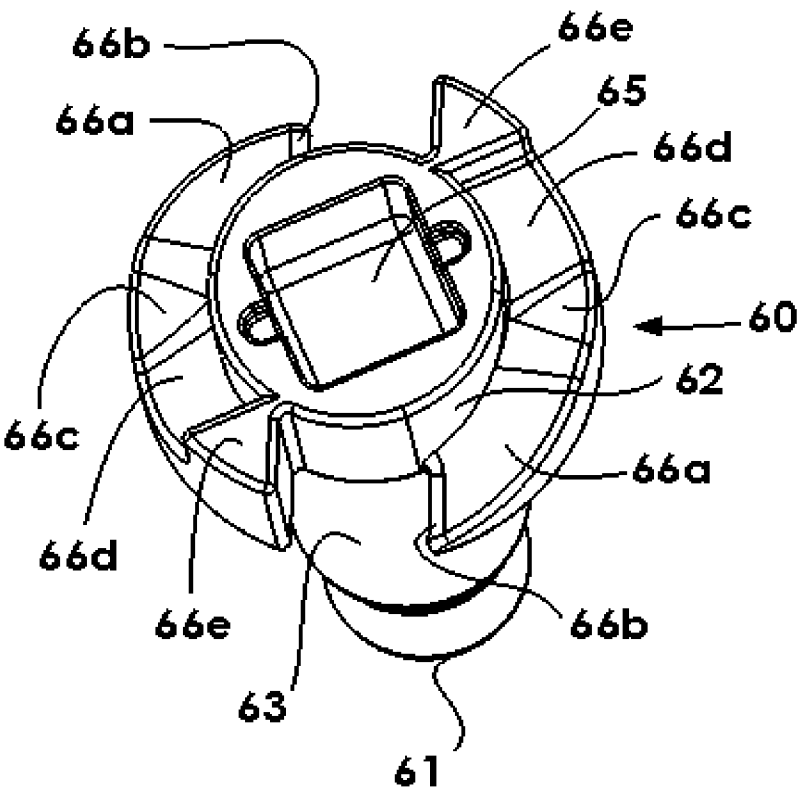
FIG. 5*b* is another pictorial representation of the locking pin of FIG. 5*a* from a different aspect.
Figure 5A:
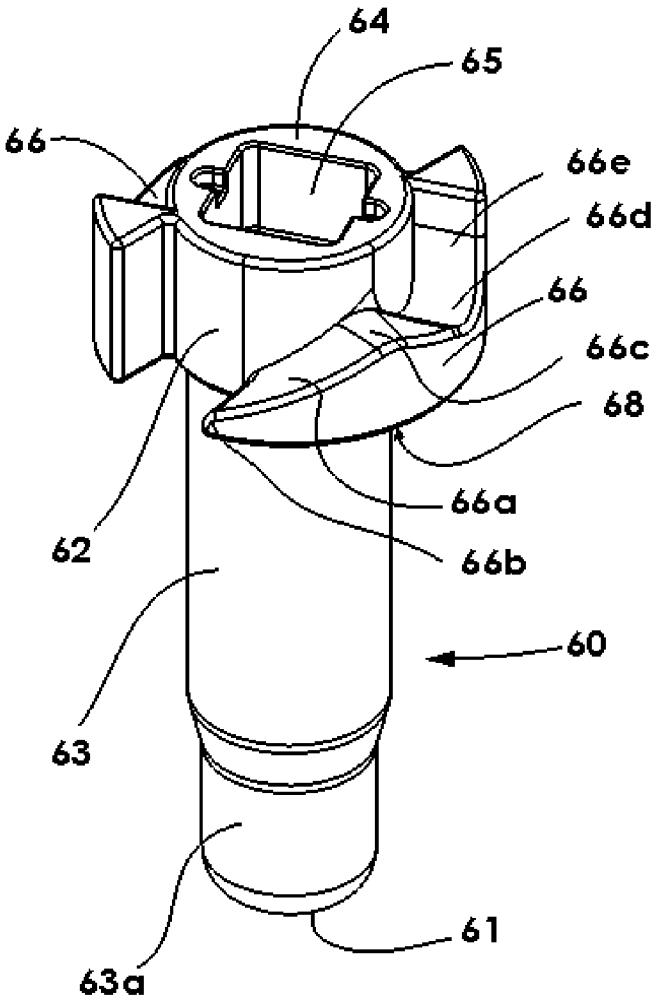
FIG. 5*a* is a pictorial representation of the locking pin used to lock the lip end protector to the lip end in FIG. 1.

As can be seen in FIG. 5*a*, locking pin 60 has a head 62 and a shank 63 extending from the head 62 to terminate in a free end 61, the shank being of constant diameter over most of its length but tapering down to a portion 63 a of smaller diameter adjacent its free end 61. In this particular embodiment, the head 62 is at one end of the pin but could be intermediate the two ends if desired.

Figure 10:
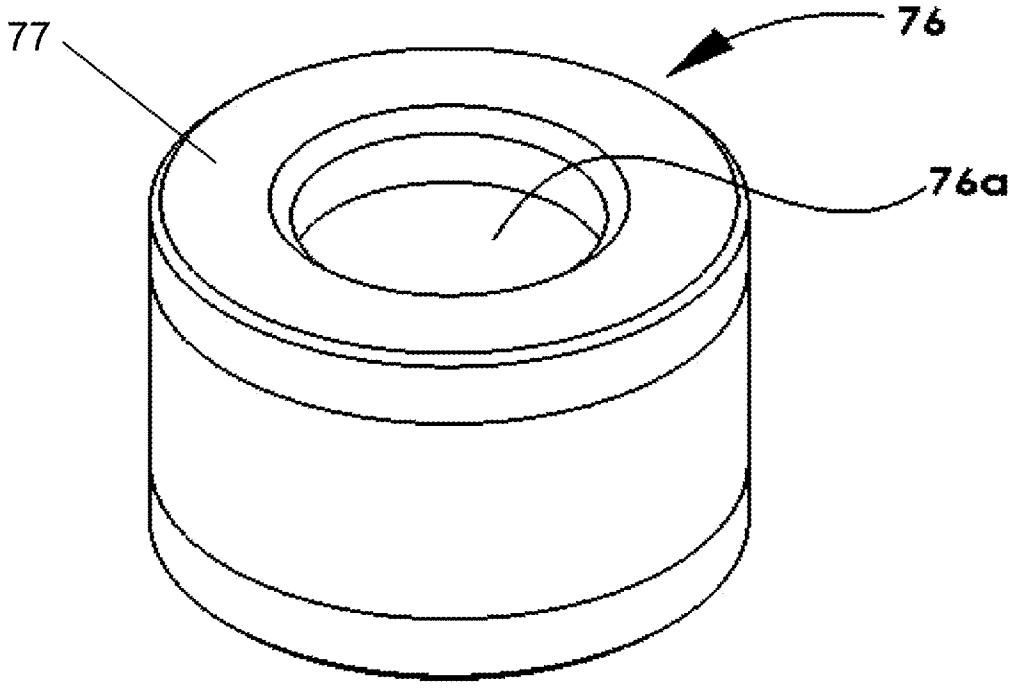
FIG. 10 is a pictorial representation of the compression washer of the assembly.

The head 62 of the locking pin comprises a generally cylindrical centre portion 64 having a square socket 65 therein adapted to receive a socket spanner drive head (not shown) for fitting and removing the locking pin 60 in the lip end protector 40. Suitably, two angularly spaced dogs or flanges 66 extend from the centre portion 64 and are adapted to engage the locking lugs 56 and 57 respectively. In that respect, as can be seen in FIG. 5*a* or FIG. 5*b*, the upper face of each dog 66 has a helical or ramp portion 66*a* which rises from a starting edge 66*b* to a crest 66*c* approximately 20 to 30 degrees around the shank 63, and then declines to a valley 66*d*, 20 to 30° (degrees) later, and then rises again for a further 10 to 150 to terminate at flange portion 66*e*, the valley 66*d* in each of the two dogs 66 forming a seat for receiving the lugs 56 and 57 respectively. It can also be seen that the lower face 68 of the two dogs 66 is generally flat or planar for the purpose of evenly engaging the upper face 77 (FIG. 10) of the compression block 76, as will become clearer later.

In use, the leg 42 of the weld on base 41 is welded to the end face 12*f* of the lip as shown in FIG. 3. For that purpose, the corners of the leg are chamfered to accommodate the weld. Further, the corners of the rails 47 and 48 of the lip end protector 40 are also chamfered to accommodate the weld.

Once the weld on base 41 has been welded to the lip end 24, the end protector 40 is slid onto the weld on base 41 from the front of the lip 12 with the flange of the T locating in the channel 45 and the opposed faces of the rails 47 and 48 slidably engaging the opposite faces of the leg of the T of the weld on base 41. Thus, the weld on base 41 provides a stable and secure mounting for the lip end protector 40.

Figure 12:
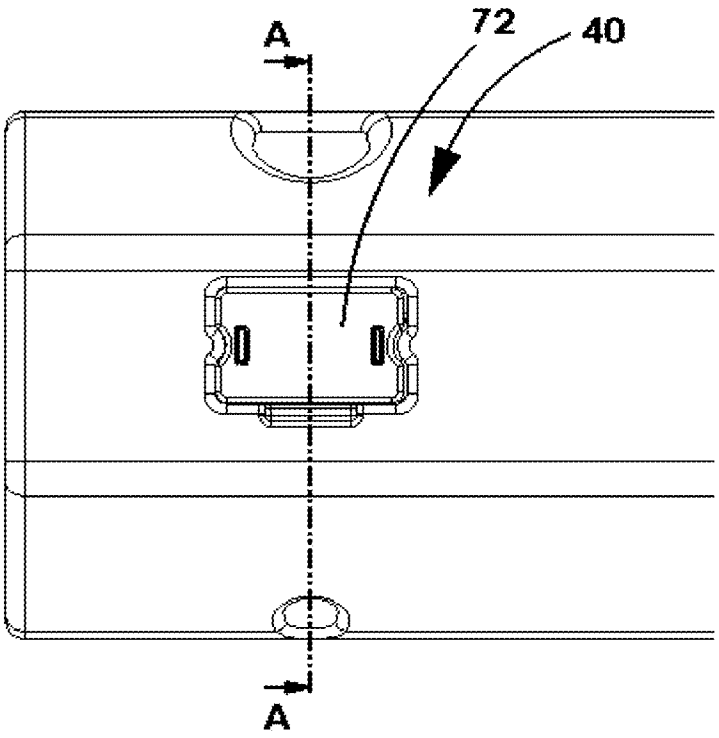
FIG. 12*a* is a part elevation of the wear part mounted on a lip end.
FIG. 12*b* is a sectional end view of the wear part of FIG. 12*a* mounted on the lip end.
Figure 12:
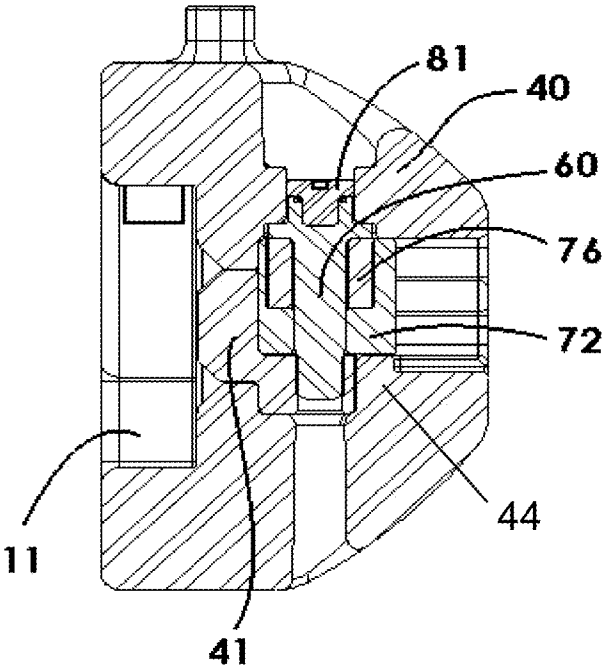

The lip end protector 40 is secured to the weld on base 41 by latching block 72 (after mounting the compression block 76 in cylindrical recess 73) which is pushed into its latching position in horizontal passage 50 so as to engage partly in recess 49 in the flange portion 43 of the weld on base 41 and partly in the side wall 44 (see, e.g., FIGS. 6, 8 and 12) of the lip end protector 40.

In order to lock the latching block 72 in the latching position, the locking pin 60 is then fitted to the vertical passage 54 by pushing it into the vertical passage 54 so that the dogs 66 pass through the angular spaces between the lugs 56 and 57 and that the lower faces 68 of the dogs engage the upper face 77 of the compression block 76 whereupon the locking pin is rotated about its longitudinal axis so that the helical or ramped up faces 66*a* of the dogs engage the inner faces (that is the bottom faces) of the lugs 56 and 57 thereby effectively winding the locking pin further into passage 54 against the force of the compression washer 76. Once the locking pin has been rotated so that the lugs 56 and 57 are angularly past crests 66*c* and seat in valleys 66*d* respectively, the biasing force of the compression washer will hold the locking pin in position against rotation thereby locking the latching block in the latching position.

Figure 11:
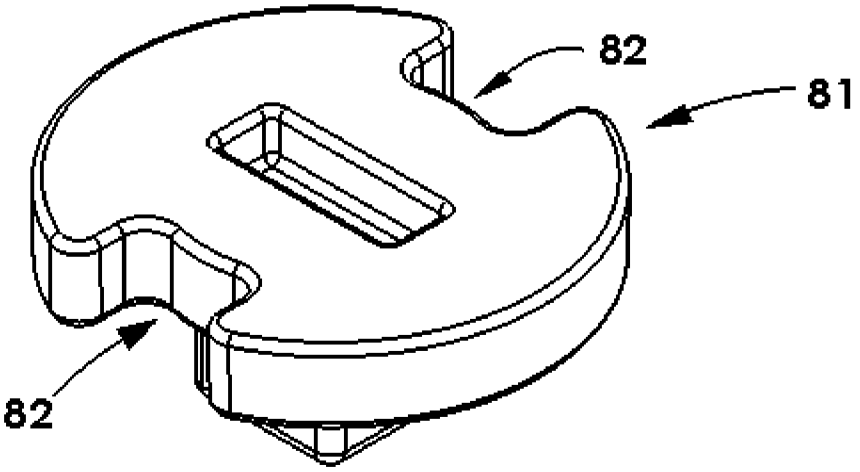
FIG. 11 is a pictorial representation of the cap seal for the locking pin shown in FIG. 5.

Once the locking pin 60 has been rotated to the locking position, a sealing cap 81 as shown in FIG. 11 can be fitted to the head of the locking pin to inhibit the ingress of fines from the spoil being mined or excavated. In that respect, the flange portions 66*e* of the dogs 66 being triangular in cross-sectional shape looked at from the head end engage with complementary recesses 82 in the sealing cap.

Advantageously, the mounting block 72 supports the compression washer 76 which in turn is formed of a flexible and resilient material adapted to absorb some shock loads being borne by the lip and protector. Further, the latching member having substantially flat opposite faces of a suitable size are able to transmit shock loads to the weld on base more effectively than a cylindrical pin.

While the foregoing description has been given by way of illustrative example of the invention, it will be understood that the invention may be embodied in many other forms and all such forms are deemed to fall within the broad scope and ambit of the invention as defined by the appended claims.

The invention claimed is:

1. A wear part and retainer system combination for earthmoving and mining equipment, the combination comprising:

a wear part configured for releasable attachment to a fixed mother part of the equipment, the wear part having a first passage extending therethrough in one direction and a second passage extending in a direction lateral to and passing through the first passage, the first and second passages each having an outer end and an inner end and the outer end of the second passage being on one side of the first passage and the inner end of the second passage being on an opposite side of the first passage;

a latching member mounted in said first passage for movement between a non-latching position and a latching position in which the latching member locks the wear part to the fixed mother part, said latching member having a recess therein and biasing means mounted in said recess;

a locking pin mounted in said second passage for selective movement therealong and through said biasing means between a retracted position in which the latching member is free to move into and out of said first passage and an extended position in which the locking pin locks said latching member in the extended position in said first passage, said biasing means being adapted to bias the locking pin towards the extended position, and wherein said wear part includes engagement means in said second passage for engagement by said locking pin to secure said locking pin in the extended position.

2. The wear part and retainer system combination according to claim 1, wherein the engagement means includes a lug extending into the second passage and adapted for engagement by the locking pin.

3. The wear part and retainer system combination according to claim 2, wherein the lug has an inner face facing towards the inner end of the second passage for engagement by the locking pin.

4. The wear part and retainer system combination according to claim 3, wherein said locking pin has a head with an outer end face adapted to engage the inner face of the lug, the outer end face leading to a seat adapted to locate the lug therein.

5. The wear part and retainer system combination according to claim 4, wherein said locking pin has an inner face, at least a portion of said inner face being spaced from said outer end face and adapted to engage said biasing means, said locking pin and said biasing means being so made and arranged that rotation of said locking pin in said second passage causes axial movement of said locking pin relative to said wear part upon movement of said outer end face against the inner face of said lug such that said lug aligns and is retained in said seat against a biasing force of said biasing means.

6. A wear part and retainer system combination for earthmoving and mining equipment, the combination comprising:

a wear part having a passage therethrough, the passage having an outer end and an inner end and a lug extending into the passage, the lug having an inner face, and the retainer system including a one-piece locking pin for locking the wear part to a mother part and biasing means for biasing the one-piece locking pin towards a locked position, the one-piece locking pin having a head and a shank which extends from the head of the one-piece locking pin and slidably through the biasing means, the head having an outer end face adapted to engage the inner face of the lug, the outer end face leading to a seat on the head and adapted to locate the lug therein, the head of the one-piece locking pin also having an inner face, at least a portion of said inner face of the one-piece locking pin being spaced from said outer end face and adapted to engage said biasing means, said one-piece locking pin and said biasing means being so made and arranged that rotation of said one-piece locking pin in said passage causes axial movement of said one-piece locking pin relative to said wear part upon movement of said outer end face against the inner face of said lug, such that said lug aligns and is retained in said seat against a biasing force of said biasing means.

7. The wear part and retainer system combination according to claim 6, wherein the outer end face of the one-piece locking pin has a helical or inclined portion leading to a peak followed by a helical or declined portion leading to a trough, the trough defining said seat.

8. The wear part and retainer system combination according to claim 6, wherein the inner face of the one-piece locking pin is provided on the head of the one-piece locking pin and is adapted to engage the biasing means, and the inner face of the head is spaced from the seat in an axial direction of the one-piece locking pin.

9. The wear part and retainer system combination according to claim 8, wherein the biasing means includes a resilient compression washer.

10. The wear part and retainer system combination according to claim 9, wherein the inner face of the head of the one-piece locking pin is substantially planar.

11. A one-piece locking pin for a retainer system, the one-piece locking pin comprising:

a shank terminating at a head, wherein the head of the one-piece locking pin includes at least two angularly spaced apart protuberances defining longitudinal passages between adjacent protuberances and each of said at least two angularly spaced apart protuberances has an outer end face having a helical or inclined portion leading to a peak followed by a helical or declined portion leading to a trough, the trough defining a seat portion on the outer end face that is adapted to locate therein a complementary lug on a wear part; and wherein the helical or inclined portion of each of the at least two angularly spaced apart protuberances rise in a same angular direction; and wherein the longitudinal passages between the angularly spaced apart protuberances are sufficient to allow complementary angularly spaced lugs extending into a complementary through passage of the wear part to pass therethrough for fitting the one-piece locking pin to the wear part.

12. The one-piece locking pin according to claim 11, wherein the head of the one-piece locking pin has an inner face adapted to engage a biasing means, the inner face being spaced from the seat portion in an axial direction of the one-piece locking pin.

13. The one-piece locking pin for a retainer system according to claim 11 including a shoulder spaced from said head, said shoulder being adapted to engage a compression washer.

14. A wear part for earthmoving and mining equipment, the wear part comprising:

a mounting portion for engaging with a mount provided on an excavator bucket, the wear part having a cavity in the mounting portion defined at least in part by a wall having an outer face and an inner face, a first passage through said wall and opening at one end to the outer face of said wall and at an other end to the inner face of said wall and a second passage extending through said wall in a direction lateral to and passing through said first passage, the first and second passages each having an outer end and an inner end and the outer end of the second passage being on one side of the first passage and the inner end of the second passage being on an opposite side of the first passage;

a pair of angularly spaced apart locking lugs extending into said second passage between said outer face and said inner face, each of said pair of angularly spaced apart locking lugs having a lower end face configured to be engaged by a locking pin having a head which includes a pair of spaced-apart lugs, each of the pair of spaced-apart lugs having a substantially helical face with an inclined portion and a declined portion and configured to pass through the pair of angularly spaced apart locking lugs extending into the second passage, each substantially helical face configured to sequentially interface with the lower end face of a corresponding one of the pair of angularly spaced locking lugs during rotation of the locking pin relative to the second passage and at least one of the pair of angularly spaced apart locking lugs; and wherein the lower end face of each of said pair of angularly spaced apart locking lugs is curved about an axis substantially perpendicular to the axis of said second passage.

15. An assembly of a wear part and a retainer system for earthmoving and mining equipment, the wear part comprising:

a passage therethrough, the passage having an outer end and an inner end and a lug having an inner face extending into the passage, the retainer system including a one-piece locking pin for locking the wear part to a mother part and biasing means mounted in said passage, the one-piece locking pin having a shank having an end terminating with a head, the shank extending slidably through the biasing means and the head having an outer end face arranged to engage the inner face of the lug, the outer end face leading to a seat adapted to locate the lug therein, the one-piece locking pin also having an inner face, at least a portion of said inner face being spaced from said outer end face and arranged to engage said biasing means to bias the one-piece locking pin to a locked position with said lug in said seat, said one-piece locking pin and said biasing means being so made and arranged that rotation of said one-piece locking pin in said passage causes axial movement of said one-piece locking pin relative to said wear part upon movement of said outer end face against the inner face of said lug, such that said lug moves into and is retained in said seat against a biasing force of said biasing means.

16. The assembly of a wear part and a retainer system according to claim 15, wherein the wear part is a lip end protector.

17. The assembly of a wear part and a retainer system according to claim 15, wherein the wear part includes a cavity configured and dimensioned to conform to and engage with a base member which is fixedly mounted to the earthmoving and mining equipment.

18. A locking pin for a retainer system according to claim 13, wherein the shoulder is adapted to engage an intermediate washer which is adapted to engage with the compression washer.

* * * * *